US010398220B2

(12) United States Patent
Alinski

(10) Patent No.: US 10,398,220 B2
(45) Date of Patent: Sep. 3, 2019

(54) TUFT-PICKING DEVICE FOR A BRUSH-MAKING MACHINE

(71) Applicant: The Procter & Gamble Company, Cincinnati, OH (US)

(72) Inventor: Jens Alinski, Kelkheim (DE)

(73) Assignee: THE PROCTER & GAMBLE COMPANY, Cincinnati, OH (US)

( * ) Notice: Subject to any disclaimer, the term of this patent is extended or adjusted under 35 U.S.C. 154(b) by 307 days.

(21) Appl. No.: 15/246,454

(22) Filed: Aug. 24, 2016

(65) Prior Publication Data

US 2017/0065072 A1 Mar. 9, 2017

(30) Foreign Application Priority Data

Sep. 3, 2015 (EP) ..... 15183597

(51) Int. Cl.

| | |
|---|---|
| ***A46D 3/08*** | (2006.01) |
| ***A46D 1/00*** | (2006.01) |
| ***A46D 1/08*** | (2006.01) |

(52) U.S. Cl.

CPC ..... *A46D 3/082* (2013.01); *A46D 1/0238* (2013.01); *A46D 1/08* (2013.01)

(58) Field of Classification Search

CPC ..... A46D 3/082; A46D 1/0238; A46D 1/08

USPC ..... 300/7

See application file for complete search history.

(56) References Cited

U.S. PATENT DOCUMENTS

| | | | | |
|---|---|---|---|---|
| 1,664,424 A * | 4/1928 | Jobst | ..... | A46D 3/082 300/7 |
| 2,349,532 A * | 5/1944 | West | ..... | A46D 3/042 300/7 |
| 3,167,355 A | 1/1965 | Aldrich | | |
| 3,606,472 A | 9/1971 | Rutkowski | | |

(Continued)

FOREIGN PATENT DOCUMENTS

| | | |
|---|---|---|
| BE | 765338 | 8/1971 |
| CN | 201468419 | 5/2010 |

(Continued)

OTHER PUBLICATIONS

International Search Report with Written opinion, dated Nov. 7, 2016, 11 pages.

*Primary Examiner* — Weilun Lo
(74) *Attorney, Agent, or Firm* — Vladimir Vitenberg

(57) ABSTRACT

A tuft-picking device for a brush-making machine includes a container for holding loose filaments with circumferences having at least one recess; and a tuft picker having a working surface having a notch. The notch has a depth, a width, and an opening. A contour of the working surface is movable during a working stroke past an open side of the container so that the opening passes the loose filaments. First and second projections reduce the opening versus an inner width. The first projection's top is located in the working surface of the tuft picker and the second projection's top is located off-site the working surface and inside the notch. The second projection passes the open side of the filament container last during a working stroke. A distance from the top of the second projection to the working surface is from 0.05 mm to 0.5 mm, and an angle between the working surface and a line of reflection symmetry crossing the top of the second projection is from 0° to 45°.

17 Claims, 6 Drawing Sheets

(56) References Cited

U.S. PATENT DOCUMENTS

| | | | | |
|---|---|---|---|---|
| 4,733,917 | A | 3/1988 | Boucherie | |
| 5,033,797 | A | 7/1991 | Rueb | |
| 5,165,759 | A | 11/1992 | Lewis, Jr. | |
| 5,344,218 | A | 9/1994 | Weihrauch | |
| 6,079,788 | A * | 6/2000 | Boucherie | A46D 3/082 300/7 |
| 6,086,373 | A | 7/2000 | Schiff et al. | |
| 6,138,314 | A | 10/2000 | Schiff et al. | |
| 6,290,302 | B1 | 9/2001 | Boucherie | |
| 6,290,303 | B1 * | 9/2001 | Boucherie | A46B 9/028 300/11 |
| 6,905,176 | B2 | 6/2005 | Boucherie | |
| 7,635,169 | B2 * | 12/2009 | Boucherie | A46D 3/082 300/2 |
| 9,192,227 | B2 | 11/2015 | Stein et al. | |
| 2001/0026093 | A1 * | 10/2001 | Boucherie | A46D 3/082 300/5 |
| 2005/0116528 | A1 | 6/2005 | Boucherie | |
| 2010/0066154 | A1 * | 3/2010 | Boucherie | A46D 3/082 300/7 |
| 2012/0013169 | A1 | 1/2012 | Rees | |
| 2013/0038115 | A1 * | 2/2013 | Stein | A46D 3/045 300/2 |

FOREIGN PATENT DOCUMENTS

| | | |
|---|---|---|
| CN | 201468429 U | 5/2010 |
| CN | 201468430 U | 5/2010 |
| DE | 2128774 | 10/1972 |
| DE | 3016790 | 11/1981 |
| DE | 4040297 | 6/1992 |
| DE | 4411652 | 10/1995 |
| DE | 19728442 | 1/1999 |
| DE | 19745024 | 4/1999 |
| DE | 19939333 | 2/2001 |
| DE | 20319767 | 6/2005 |
| DE | 102005045827 | 3/2007 |
| DE | 102005056968 | 5/2007 |
| DE | 102007047066 | 4/2009 |
| DE | 102008059121 | 5/2010 |
| EP | 0016508 | 10/1980 |
| EP | 0206385 | 12/1986 |
| EP | 0289676 | 11/1988 |
| EP | 0346965 | 12/1989 |
| EP | 0432868 | 6/1991 |
| EP | 0681796 | 11/1995 |
| EP | 0916283 | 5/1999 |
| EP | 2654501 | 10/2013 |
| GB | 1146518 | 3/1969 |
| JP | H01254112 | 10/1989 |
| JP | 05015412 | 1/1993 |
| JP | 06277119 | 10/1994 |
| JP | 2003169719 | 6/2003 |
| WO | WO200010814 | 3/2000 |
| WO | WO200949850 | 4/2009 |

* cited by examiner

TUFT-PICKING DEVICE FOR A BRUSH-MAKING MACHINE

FIELD OF THE INVENTION

There is provided a tuft-picking device for a brush-making machine for automated production of brushes, in particular toothbrushes. The tuft-picking device comprises a filament container for holding a supply of loose filaments and for providing said loose filaments to a tuft picker; said tuft picker comprising a tuft-picking notch for taking up a predefined number of loose filaments from the filament container. The tuft-picking notch comprises an opening which is limited by two projections one at each side of the opening. The top of one projection is part of the working surface of the tuft picker and the top of one projection is located off-site the area of the working surface of the tuft picker, but is located inside the notch. During one working stroke the working surface of the tuft picker comprising the tuft-picking notch is transferred along the loose filaments, wherein the projection which is located in the working surface separates some filaments from the filament container and the projection which is located off-site the working surface of the notch keeps the filaments inside the notch.

BACKGROUND OF THE INVENTION

The bristle field of modern toothbrushes comprises multiple filament tufts. A filament tuft comprises a predefined number of individual filaments which are arranged to each other with parallel length axes. During manufacturing of toothbrushes these filament tufts are separated from a filament reservoir, also known as filament container, comprising a plurality of filaments loosely arranged with parallel length axes. One side of the filament container is open or comprises an opening so that the filaments can be transferred continuously against said opening. At the opening the filaments can be taken out by a tuft picker. Said tuft picker comprise at least one tuft-picking notch which dimension is identical to the dimension of the filament tuft to be produced. Different tuft-picking devices are known in the state of the art, e.g. devices comprising tuft-picking notches of different size (U.S. Pat. No. 7,635,169B2) or shape (US 2013/0038115 A1). However, these devices are only applicable to round filaments comprising a more or less homogeneous surface and diameter.

Toothbrush development focusses on cleaning performance looking continuously for new filaments with a different cleaning property compared to the standard round filaments, Nowadays, irregular filaments, in particular filaments comprising depressions, recesses or the like along their length axes came into fashion as these filaments take up the removed dust and complement current cleaning performance. Prominent examples for said new kind of filaments are X-shaped filaments. Unfortunately, X-shaped filaments cannot be produced with the present manufacturing devices. One problem is the picking process, as the current picking devices do not work properly for X-shaped filaments. The problems are inter alia splicing of filaments, picking different numbers of filaments up to picking no filaments and/or losing picked filaments after having picked them so that X-shaped filament tufts cannot be formed properly at the moment. In particular splicing of filaments causes problems for the final toothbrush as sharp edges might hurt the gum of the toothbrush user.

That means, a need exists for a new tuft picker which is adapted to pick filaments comprising depressions, recess etc., including X-shaped filaments. Thus, it is the object of the present application to provide such a new tuft picker which picks filaments comprising depressions, recess etc., such as X-shaped filaments, with a high operational reliability regarding number of filaments and without any splicing.

SUMMARY OF THE INVENTION

In accordance with one aspect, there is provided a tuft-picking device for a brush-making machine, comprising a filament container for holding a supply of loose filaments in a mutually parallel condition, wherein the circumference of at least one of the loose filaments comprises at least one recess. A tuft picker has a working surface comprising at least one tuft-picking notch with a depth, a width, and an opening. A contour of the working surface is configured to be movable during a working stroke past an open side of the filament container so that the opening of the tuft-picking notch passes the loose filaments. There are two projections that reduce the opening of the tuft-picking notch versus an inner width, wherein a top of a first projection is located in the working surface of the tuft picker and a top of a second projection is located off-site the working surface of the tuft picker and inside of the notch. The second projection passes the open side of the filament container last during a working stroke. A distance from the top of the second projection to the working surface of the tuft picker is in the range of from 0.05 mm to 0.5 mm; and an angle between the working surface of the tuft picker and a line of reflection symmetry crossing the top of the second projection is in the range of from 0° to 45°.

In accordance with another aspect, there is provided a brush-making machine comprising a tuft-picking device as disclosed herein.

In accordance with another aspect, there is provided a method of providing filament tufts comprising a predefined number of filaments for the manufacturing of brushes, in particular toothbrushes, wherein the method uses a tuft-picking device as disclosed herein and wherein at least one filament of the predefined number of filaments for the filament tuft comprises a circumference which comprises at least one recess and/or is an X-shaped filament.

In accordance with another aspect, there is provided a brush, in particular a toothbrush, comprising at least on filament tuft comprising at least one filament which circumference comprises at least one recess and/or is an X-shapes filament.

BRIEF DESCRIPTION OF DRAWINGS

These and other features will become apparent not only from the claims but also from the following description and the drawings, with the aid of which example embodiments are explained below.

DETAILED DESCRIPTION OF THE INVENTION

Figure 1:
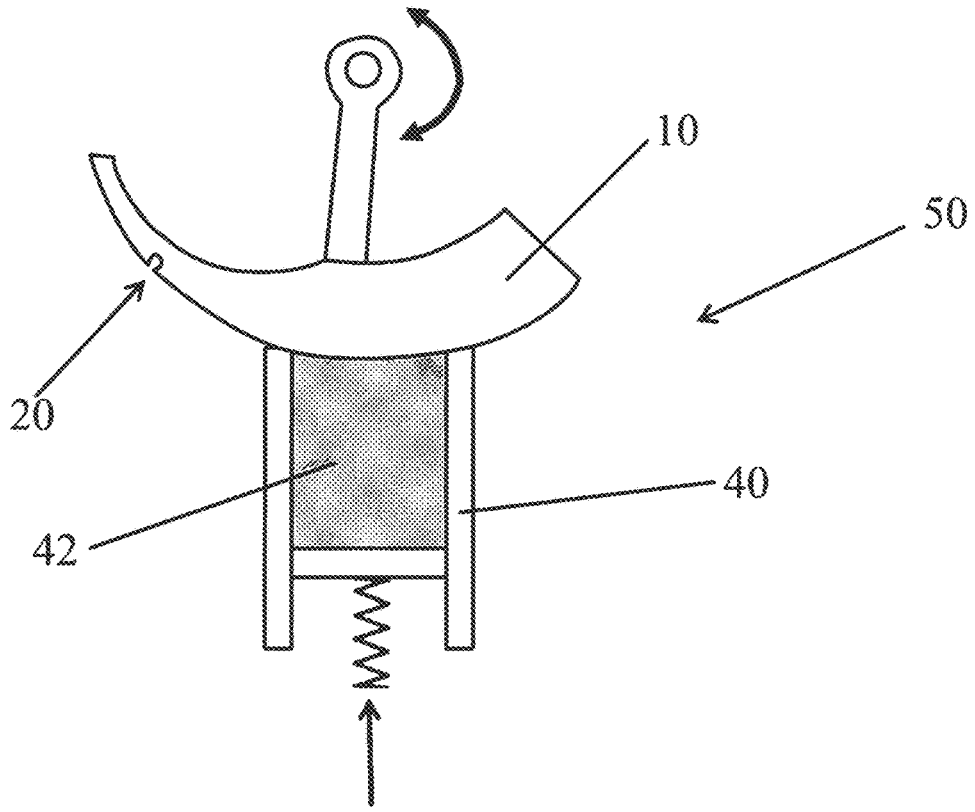
FIG. 1 shows a schematic sketch of a tuft-picking device 50 for brush-making machines using a stapling process comprising a tuft picker 10 with a tuft-picking notch 20.

The following is a description of numerous versions of a tuft-picking device comprising a tuft picker suitable to provide X-shaped filaments for brush production, in particular for toothbrush production. The description further discloses a method using said device which can be used to produce (tooth)brushes and the produced toothbrushes themselves. The description is to be construed as exemplary only and does not describe every possible embodiment since describing every possible embodiment would be impractical, if not impossible, and it will be understood that any feature, characteristic, structure, component, step or methodology described herein can be deleted, combined with or substituted for, in whole or in part, any other feature, characteristic, structure, component, product step or methodology described herein. In addition, single features or (sub)combinations of features may have inventive character irrespective of the feature combination provided by the claims, the respective part of the specification or the drawings.

As used herein, the word "about" means±10 percent. As used herein, the word "comprise," and its variants, are intended to be non-limiting, such that recitation of items in a list is not to the exclusion of other like items that may also be useful in the devices and methods of this invention. This term encompasses the terms "consisting of". As used herein, the word "include," and its variants, are intended to be non-limiting, such that recitation of items in a list is not to the exclusion of other like items that may also be useful in the devices and methods of this invention. As used herein, the words "preferred", "preferably" and variants refer to embodiments of the invention that afford certain benefits, under certain circumstances. However, other embodiments may also be preferred, under the same or other circumstances. Furthermore, the recitation of one or more preferred embodiments does not imply that other embodiments whether described herein in detail or not are not useful, and it is not intended to exclude other embodiments from the scope of the invention.

There is provided a tuft-picking device for a brush-making machine. The tuft-picking device comprises a filament container for holding a supply of loose filaments in a mutually parallel condition wherein the circumference of the loose filaments comprises at least one recess. A "filament container" as understood herein shall comprise any container of any geometrical shape which is suitable to store the loose filaments in parallel. A plurality of filaments is arranged in the filament container along their length axis. That means each filament element is arranged with its length axis in parallel to the adjacent filaments. The filament container comprises one open side or an opening is present in one side wall. At that opening the filaments are exposed to the environment, in particular are exposed to a tuft picker and can be removed from the filament container by said tuft picker. Opposite to the opening of the filament container a plunger etc. might be arranged which continuously presses the loose filaments against the opening of the filament container.

Filaments may be for example monofilaments made from plastic material. Suitable plastic material used for filaments may be polyamide (PA), in particular nylon, polybutylterephthalate (PBT), polyethylterephthalate (PET) or mixtures thereof. In addition, the filament material may comprise additives such as abrasives, color pigments, flavors etc. . . . . For example an abrasive such as kaolin clay may be added and/or the filaments may be colored at the outer surface in order to realize indicator material. The coloring on the outside of the material is slowly worn away during use to indicate the extent to which the filament is worn. Suitable additives to filaments used for tuft filaments are for example UV-brighteners, signaling substances, such as the indicator color pigments and/or abrasives. The diameter of the filament may be in the range from about 0.1 mm to about 0.5 mm, in particular in the range from about 0.15 to about 0.4 mm, more particular in the range of about 0.18 to about 0.35 mm or any other numerical range which is narrower and which falls within such broader numerical range, as if such narrower numerical ranges were all expressly written herein. Filament diameters are produced with a tolerance of 10%. A "recess" as understood herein in the filament circumference, diameter and/or volume shall mean any depression, cavity, slot or other geometric recess which amends the filament volume. The filament comprising at least one recess in its circumference may comprise one or more recesses along the circumference of the filament. A suitable example for a filament comprising at least one recess is an X-shaped filament. X-shaped filaments comprise four recesses and two lines of reflection symmetry each crossing two recesses which are located opposite to each other. In addition, all four recesses might be equal. The included angle of the X-shape filaments might be in the range of from about 40° to about 160°.

Length of the filament depends on the intended use. Generally, a filament can be of any suitable length for transporting, such as about 1200 mm and in then cut into pieces of the desired length. The length of a filament in a toothbrush influences the bending forces needed to bend the filament. Thus, the length of a filament can be used to realize different stiffness of filaments in a brush pattern. The typical length of a filament for a brush, in particular a toothbrush, may be in the range from about 5 mm to about 18 mm, in particular in the range from about 6 mm to about 15 mm, more particular in the range of about 7 mm to about 13 mm or any other numerical range which is narrower and which falls within such broader numerical range, as if such narrower numerical ranges were all expressly written herein. The filaments stored in the filament container as disclosed herein are intended to be mounted to a brush by anchor wires. These filaments typically have a doubled length compared to the filaments which are mounted to a brush by anchor free techniques. In addition the filaments in the filament container may be longer than the final filament length in the resulting brush head so that the filaments from one filament container can be cut to different specific final lengths. The filaments in the filament container may be longer than the final filaments in the range from about 0.5 mm to about 5 mm, in particular in the range from about 1 mm to about 4 mm, more particular in the range of about 1.5 mm to about 3 mm or any other numerical range which is narrower and which falls within such broader numerical range, as if such narrower numerical ranges were all expressly written herein. In particular, if the brushes are manufactured by anchor technology as intended herein, all filament tufts are mounted into the brush head first and then the filaments are cut into their final length. After cutting the cut ends are end-rounded in order to remove the sharp ends which could hurt the gums of the user of the brush. The process of end-rounding comprises several successive polishing steps, preferably using decreasing abrasiveness.

The filaments in the brush head are grouped in filament tufts. A suitable number of filaments to form one filament tuft may be for example in the range of about 10 to about 80, or in the range of about 15 to about 60, or in the range of about 20 to about 50, or any other numerical range which is narrower and which falls within such broader numerical range, as if such narrower numerical ranges were all expressly written herein. The predefined number of filaments which shall form one filament tuft is separated from the filament container mechanically, i.e. by a picking mechanism. "Picking" as understood herein shall mean that the filaments may be pushed perpendicular to their length axis continuously from the filament container in the direction of a tuft picker having a tuft-picking notch able to accept the predefined number of filaments. The picked number of filaments, named filament tuft, is then transferred to a brush-making machine and mounted into a brush head.

A "tuft picker" as disclosed herein comprises a working surface comprising at least one tuft-picking notch. Said tuft-picking notch is a recess along the working surface, thus comprising a depth, a width along the depth and an opening in/at the working surface of the tuft picker. The contour of the working surface is adapted to be movable during a working stroke past an open side of the filament container. A "working stroke" as understood herein is any movement of the tuft picker which passes the opening of the tuft-picking notch along the loose filaments in the filament container, wherein filaments are pressed into the notch by the plunger of the filament container and are finally removed from the filament container.

The opening of the tuft-picking notch is reduced by two projections which reduce the opening compared to the width of the notch. A top of a first projection is located in the working surface of the tuft picker so that the top of said projection may help to separate filaments from the filament container. A top of a second projection is located off-site the working surface of the tuft picker and inside of the notch. Said second projection which is located inside the notch is located at said side of the opening which passes the open side of the filament container last during one working stroke. That means for example, if the working stroke is an alternating movement the notch may passes two times the filament container, but only the second movement determines the finally picked number of filaments. The second projection which passes the filament container last is a symmetric geometric body comprising a line of reflection symmetry crossing a top of the second projection. A distance from said top to the working surface of the tuft picker is in the range of from about 0.05 mm to about 0.5 mm and an angle between the working surface of the tuft picker and the line of reflection symmetry crossing the top of the second projection is in the range of from about 0° to about 45°.

Additionally or alternatively, the distance from the top of the second projection to the working surface of the tuft picker might be adapted to the size or thickness of the filaments to be picked. An optimal distance from the top of the second projection to the working surface of the tuft picker is about a half of the thickness of the filament and/or about the distance from the middle of the recess of the filament to the working surface of the tuft picker. Suitable distances are in the range of from about 0.05 mm to about 0.4 mm, preferably in the range from about 0.05 mm to about 0.35 mm more preferred in the range from about 0.08 mm to about 0.3 mm or any other numerical range which is narrower and which falls within such broader numerical range, as if such narrower numerical ranges were all expressly written herein.

Additionally or alternatively, the top of the second projection projects into the tuft-picking notch in an amount which is adapted to the recess of the filaments to be picked. The projection is measured compared to a theoretical straight side wall of the notch ending at the opening. An optimal projection is about the depth of the recess so that the whole surface of the projection tangents the recess of the filament. Less projecting projections are also possible as long as the recess of the filaments is positioned reliably at the projection.

Suitable projections project in in the range of from about 0.025 mm to about 0.25 mm, preferably in the range of from about 0.025 mm to about 0.2 mm, more preferred from about 0.04 mm to about 0.15 mm into the tuft-picking notch or any other numerical range which is narrower and which falls within such broader numerical range, as if such narrower numerical ranges were all expressly written herein.

Additionally or alternatively, the angle between the working surface of the tuft picker and the line of reflection symmetry crossing the top of the second projection may be adapted to the recess of the filaments to be picked. An optimal angle is complementary to the contour of the recess so that the whole surface of the projection tangents the recess of the filament. Suitable angles are in the range of from about 0° to about 40°, preferably in the range of from about 5° to about 20°, more preferred in the range of from about 8° to about 15° or any other numerical range which is narrower and which falls within such broader numerical range, as if such narrower numerical ranges were all expressly written herein.

The contour of the working surface of a tuft picker may be straight or circular. Circular tuft picker are usually preferred. That means a working stroke may be a linear movement or a circular movement depending on the contour of the tuft picker. If the tuft picker contour is circular the angle between the line of reflection symmetry of the second projection and the working surface of the tuft picker is measured between the line of reflection symmetry of the second projection and the tangent tangenting the working surface of the tuft picker at the middle of the tuft-picking notch. If the tuft picker is a circular arc the circular arc comprises preferably a curvature/diameter in the range from about 80 mm to about 300 mm, more preferred with a curvature/diameter in the range from about 100 mm to about 200 mm or any other numerical range which is narrower and which falls within such broader numerical range, as if such narrower numerical ranges were all expressly written herein.

Additionally or alternatively, the tuft-picking notch can principally be of any geometrical form. Suitable forms are, for example, a circle, an oval, a polygon, preferably a convex polygon, a cyclic polygon, a regular square, an irregular square, a polygon with rounded angles or a combination thereof. The form of the tuft-picking notch is chosen such that the filaments to be picked are trapped inside the notch. In particular, any active removal from the notch such as swirls which might be formed in the notch shall be avoided by the form of the tuft-picking notch as disclosed herein. Preferably the tuft-picking notch is a cyclic polygon, in particular a cyclic polygon with rounded angles. The internal surface of the tuft-picking notch may be regularly or irregularly. An irregular internal surface of the tuft-picking notch is preferred as any movement of the filaments in the notch is inhibited thereby.

Additionally or alternatively, the width of the tuft-picking notch may vary along the depth of the notch. That means the width at the bottom of the tuft-picking notch may be larger than the width of the opening of the notch and/or the width at the bottom of the tuft-picking notch may be larger than the width at the projections reaching into the notch and/or larger than the width beyond the projections. Variation of the width along the depth of the notch helps in keeping the filaments in the notch during the movement of the tuft picker.

Additionally or alternatively, the depth of the tuft-picking notch may vary along its width. That means the depth may vary along the opening of the tuft-picking notch and/or the depth may vary in the range of the projections. For example, the depth of the notch may be smaller at the side of the opening comprising the projection which is located inside of the notch than at the side of the opening comprising the projection which is located at the working surface of the tuft picker. Preferably, the depth of the notch is from about 5% to about 20% smaller, from about 5% to about 15% smaller, from about 5% to about 10%, smaller at the side of the notch comprising the projection which is located inside the notch or smaller of any other numerical range which is narrower and which falls within such broader numerical range, as if such narrower numerical ranges were all expressly written herein. The depth may vary homogeneously or non-homogeneously along the width of the tuft-picking notch.

Additionally or alternatively, the width of the tuft-picking notch may be smaller than the depth of the tuft-picking notch. Said oblongness may help to pick filaments comprising at least one recess as well to keep the filaments in the tuft-picking notch during the movement of the tuft picker. For example, the width may be in the range from about 0.5 mm to about 5 mm and/or the depth may be in the range of from about 0.5 mm to about 7 mm or any other numerical range which is narrower and which falls within such broader numerical range, as if such narrower numerical ranges were all expressly written herein.

Additionally or alternatively, the depth of the tuft-picking notch can be adapted between two successively performed working strokes. By varying the depth of the tuft-picking notch, the size of the tuft-picking notch is varied. The size of the tuft-picking notch corresponds to the predefined number of filaments picked which form one filament tuft after picking. That means, if the size of the tuft-picking notch is varied, different filament tufts can be picked with one tuft picker. The size of the tuft-picking notch may be varied between each working stroke or more than one working stroke with each notch size are performed successively in order to speed up the picking process.

Additionally or alternatively, the tuft-picking notch may comprise a third projection which is located inside of the notch adjacent to the second projection. Said third projection may be similar or differently formed compared to the other two projections, in particular the third projection may be similar formed compared to its adjacent projection which is also located inside the tuft-picking notch. For example, the third projection may be symmetrically shaped having a line of reflection symmetry crossing a top of the third projection. Additionally or alternatively, an angle between the line of reflection symmetry crossing the top of the third projection and the working surface of the tuft-picking notch may be equal or smaller than the angle between the second projection and the working surface. Preferably, the angle between the third projection and the working surface is about 10° smaller than the angle between the second projection and the working surface.

Additionally or alternatively, the top of the third projection may project less into the notch than the top of the second projection, preferably the top of the third projection may projects about 5% less, about 10% less, about 15% less or any other numerical range which falls within such broader numerical range, as if such narrower numerical ranges were all expressly written herein.

The third projection may further help to trap the picked filaments inside the notch. Therefore it might be helpful, if the width of the tuft-picking notch at the bottom of the notch may be larger than at and/or beyond the third projection. Additionally or alternatively, a top of the third projection is spaced from the top of the adjacent second projection with a distance which is equal to the distance from the top of the second projection to the working surface of the tuft picker. Additionally or alternatively, the distance between the third and the second projection might by equal plus about 10% or equal minus about 10% of the distance from the top of the second projection to the working surface of the tuft picker.

Additionally or alternatively, the present disclosure provides further a method of providing filament tufts for brush making production, in particular for toothbrush making production. Said filament tufts comprise a predefined number of filaments, wherein at least one filament comprises a circumference which comprises at least one recess. A "predefined number of filaments" as understood herein means a number which is set by the size of the tuft-picking notch of the tuft picker as disclosed herein and which is used in a picker device. Said predefined number may vary in the number of the selected and picked filaments in range of about 25% above or below the set number. The method comprises using at least a tuft picker as disclosed herein and comprises further separating laterally the filaments from a quantity of loose fibers in order to form a filament tuft. The filaments picked comprise preferably four recesses, in particular, the filaments picked with the method as disclosed herein are X-shaped filaments.

Additionally or alternatively, the present disclosure provides further a brush, in particular a toothbrush comprising at least on filament tuft comprising at least one filament which circumference comprises at least one recess. Said brush is manufactured using a method and/or a tuft-picking device as disclosed herein. Preferably, the brush and/or toothbrush produced comprise at least one filament tuft comprising X-shaped filaments.

In the following, a detailed description of several example embodiments will be given. It is noted that all features described in the present disclosure, whether they are disclosed in the previous description of more general embodiments or in the following description of example embodiments of the devices, even though they may be described in the context of a particular embodiment, are of course meant to be disclosed as individual features that can be combined with all other disclosed features as long as this would not contradict the gist and scope of the present disclosure. In particular, all features disclosed for either one of the device or a part thereof may also be combined with and/or applied to the other parts of the device or a part thereof, if applicable.

FIG. 1 shows a schematic view of a tuft-picking device 50 for brush-making machines using a stapling process for mounting filament tufts into a brush, in particular into a toothbrush. The tuft-picking device 50 comprises at least a tuft picker 10 and a filament container 40. Further components which might belong to the tuft-picking device 50 are not shown in order to facilitate FIG. 1. The filament container 40 is suitable for holding a plurality of loose filaments 42 in a mutually parallel condition. That means the filaments 42 are located with parallel length axes in the filament container 40, wherein the length axes of the filaments 42 are parallel to the side walls of the filament container 40. The filaments 42 may be for example monofilaments made from plastic material such as polyamide (PA), in particular PA 6.10 or PA 6.12. The diameter of the filament may be in the range from about 0.18 mm to about 0.35 mm or and the filaments may be cut into pieces of a length in the range of about 11 mm to about 46 mm.

The filament container 40 may be of any geometrical shape as long as the filaments 42 can be stored therein. For examples, the filament container 40 comprises two side walls which are immovable, one movable side wall and one open side. The movable side wall is located opposite to the open side and is moved into the direction of the open side, thereby moving the plurality of filaments 42 stored in the filament container 40 in the same direction. At the open side the filaments 42 are in contact with the tuft picker 10. The tuft picker 10 comprises at least one tuft-picking notch 20 which is suitable to take up filaments 42 from the filament container 40. The tuft picker 10 is attached to the tuft-picking device 50 in such that the tuft picker 10 can be moved. The surface contour of the tuft picker 10 shown in FIG. 1 is circular and the movement of the tuft picker 10 is a circular movement as well. A working stroke, meaning the movement of the tuft picker 10 that brings the tuft-picking notch 20 into contact with the filaments 42 located in the filament container 40 is a circular movement as well. Preferably, the tuft-picking notch 20 is moved up to the middle of the open side of the filament container 40, filled with filaments 42 and removed into the position outside the filament container 40 (as shown in FIG. 1). In the position outside the filament container 40 the filaments 42 can then be removed from the tuft-picking notch 20 in order to be mounted to a brush.

Figure 2A:
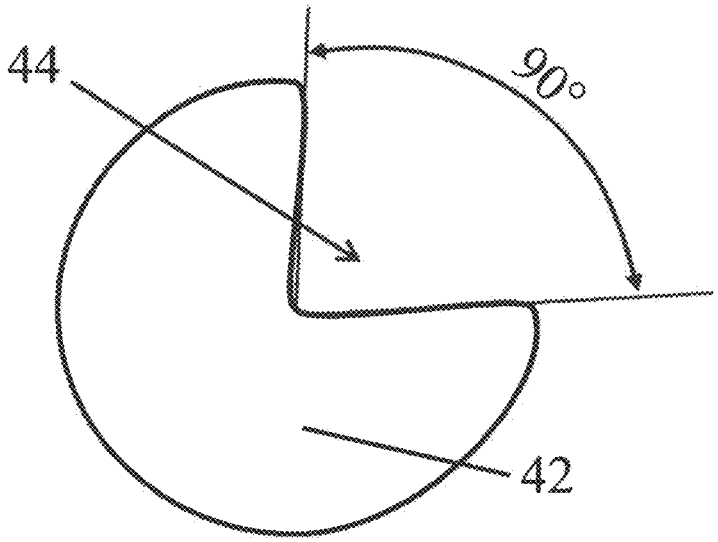
FIG. 2A shows a sectional view of a filament 42 comprising one recess 44 in its circumference.
Figure 2B:
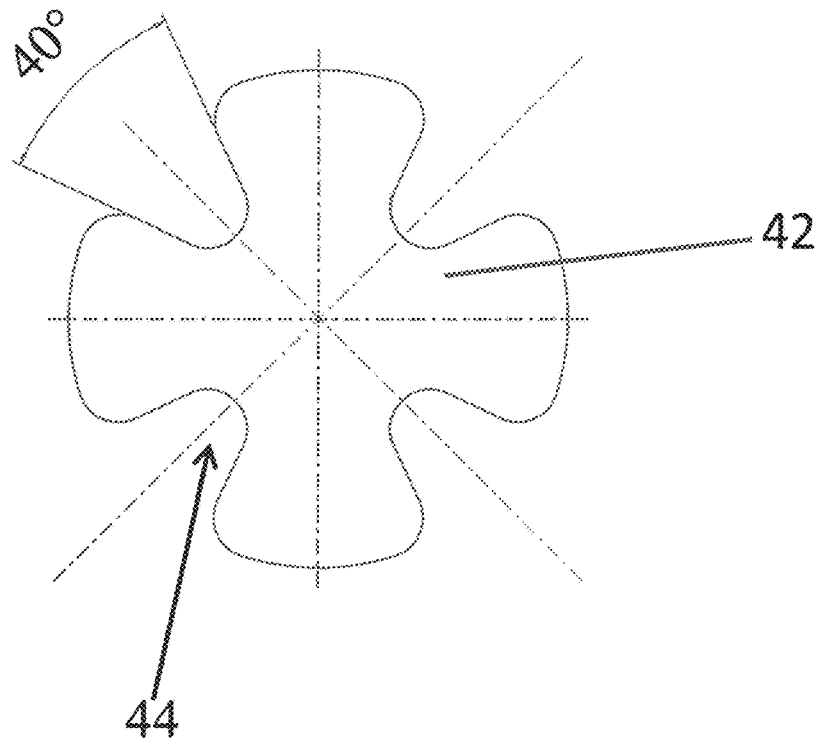
FIGS. 2B, 2C, 2D show sectional views of three different filaments 42 comprising four recesses 44 in their circumference, thus being X-shaped; different included angles are shown.
Figure 2C:
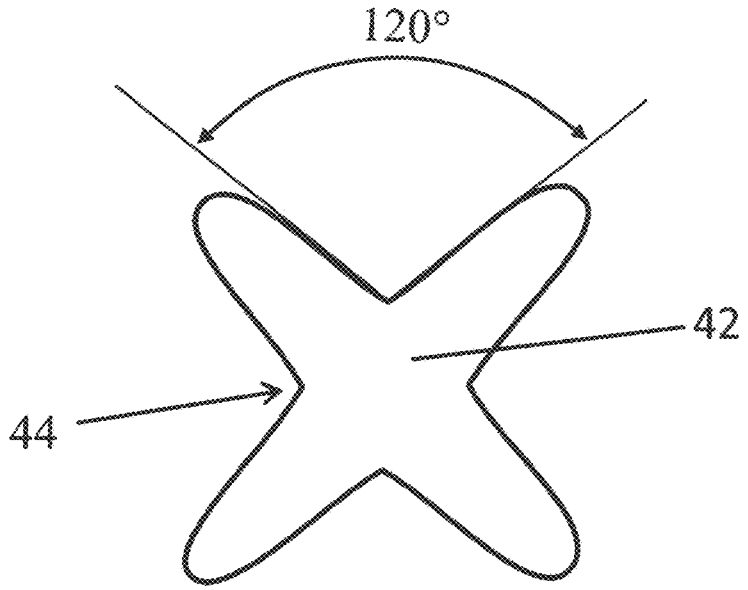
Figure 2D:
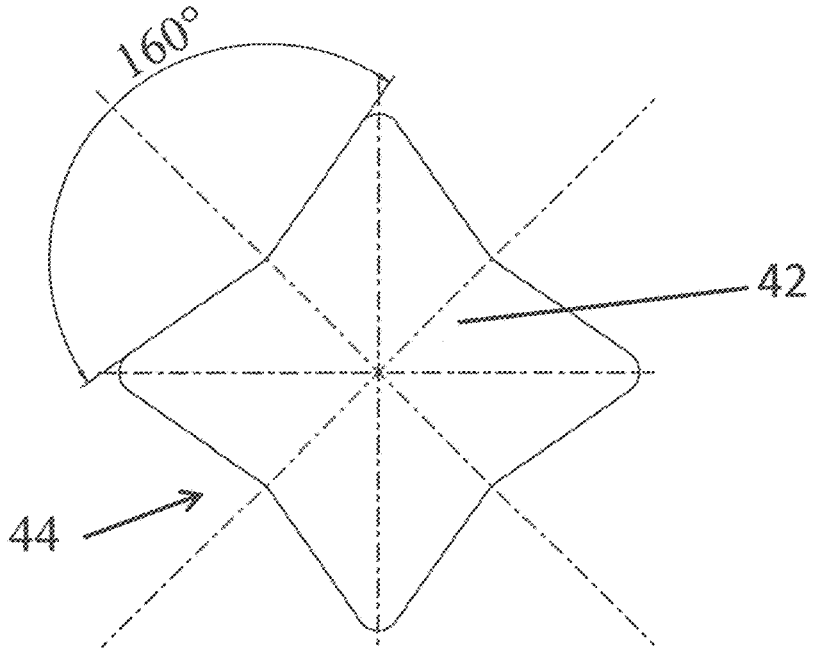

FIG. 2A shows a schematic sketch of a filament 42 comprising one recess 44 in its circumference. The recess 44 might be until the middle of the filament 42 as shown or might be less deep. The included angle of the recess 44 is about 90°. The diameter of the filament 42 may be in the range of from about 0.18 mm to about 0.35 mm FIGS. 2B, 2C and 2D show a filament 42 comprising four recesses 44 in its circumference, respectively. The four recesses 44 are arranged regularly around the circumference of the filament 42, thereby forming an X-shaped filament. Different forms and sizes of recesses are shown in FIGS. 2B, 2C and 2D. The maximal dimension of an X-shaped filament 42 may be in the range of from about 0.18 mm to about 0.35 mm. The included angle of each of the recesses 44 of the X-shaped filament 42 may be in the range of from about 40° to about 160°. Different included angles are shown, namely 40° (FIG. 2B), 120° (FIG. 2C) and 160° (FIG. 2D). The depth of the recesses 44 is less than until the middle of the filament in order to have a robust bulk in the middle of the filament 42. A suitable depth of a recess 44 is in the range of about 0.025 mm to about 0.25 mm, preferably of about 0.04 mm to about 0.15 mm. The four recesses 44 may be equal to each other in form, shape, size and opening angle as shown or may be different to each other. Regarding X-shaped filaments 42 at least the two opposite recesses 44 are preferably equally formed compared to each other.

Figure 3:
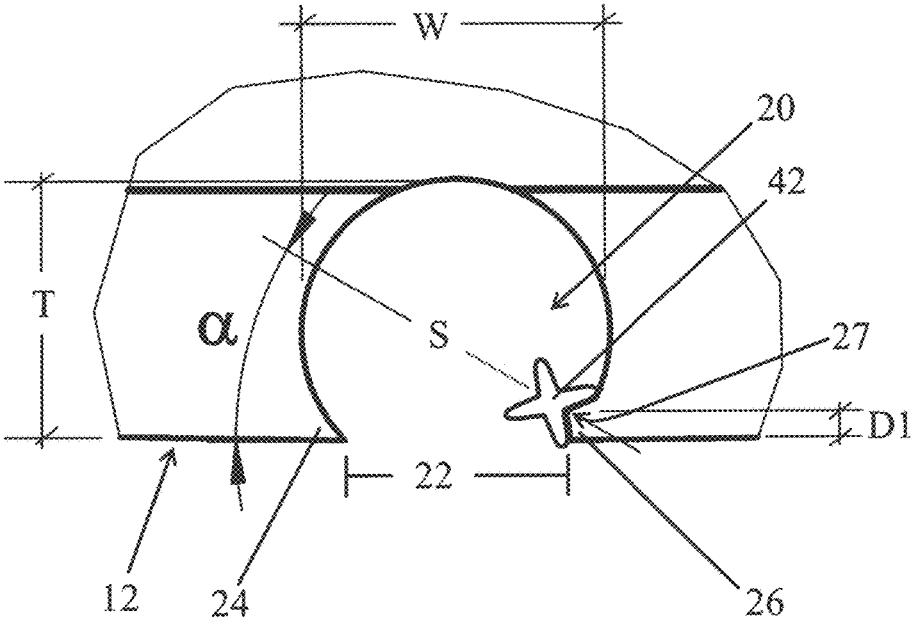
FIG. 3 shows a schematic sketch of one embodiment of the tuft-picking notch 20 having a protrusion 26 located off-site a working surface 12 of the notch 20.

FIG. 3 shows schematically an embodiment of a tuft-picking notch 20 which might be located in a tuft picker 10 as shown in FIG. 1. The tuft-picking notch 20 comprises a first protrusion 24 comprising a top 25 which is located in the layer of the working surface 12 of the tuft-picking notch 20. That means a top of the first projection 24 limits an opening 22 of the tuft-picking notch 20. In addition, the tuft-picking notch 20 comprises a second protrusion 26 which top 27 is located off-site the working surface 12 of the notch 20. "Located off-site" means herein that the second protrusion 26 is located inside of the notch 20, in particular a top 27 of the second protrusion 26 is located inside the tuft-picking notch 20. That means the opening 22 is not limited by the top 27 of the second protrusion 26. A distance D1 from the top 27 of the second protrusion 26 to the working surface 12 and the projection of the top 27 into the notch 20 are in the range of about 0.08 mm to about 0.3 mm. The second projection 26 is formed symmetrically, thus comprising a line of reflection symmetry S crossing the top 27 of the projection 26. The angle $\alpha$ between the working surface 12 of the tuft picker 10 and the line of reflection symmetry S crossing the top 27 of the second projection 26 is in the range of about 30°. If the contour of the tuft picker 10 is circular the angle $\alpha$ between the line of reflection symmetry S of the second projection 26 and the working surface 12 of the tuft picker 10 is measured between the line of reflection symmetry S of the second projection 26 and the tangent tangenting the working surface 12 of the tuft picker 10 at the middle of the opening 22 of the tuft-picking notch 20. If the tuft picker 10 is a circular arc the circular arc comprises preferably a curvature/diameter in the range from 80 mm to 300 mm, more preferred with a curvature/diameter in the range from 100 mm to 200 mm.

The tuft-picking notch 20 shown in FIG. 3 is a circular notch 20. Thus, the width W is identical to the diameter of the circular notch 20. A suitable width W is in the range of from about 0.5 mm to about 5 mm. The depth T of the tuft-picking notch 20 ranges from a bottom of the notch 20 to the opening 22 of the notch 20. The depth T is smaller than the width W. A suitable depth T is in the range of from about 0.5 mm to about 4 mm due to the flat opening 22.

Figure 4:
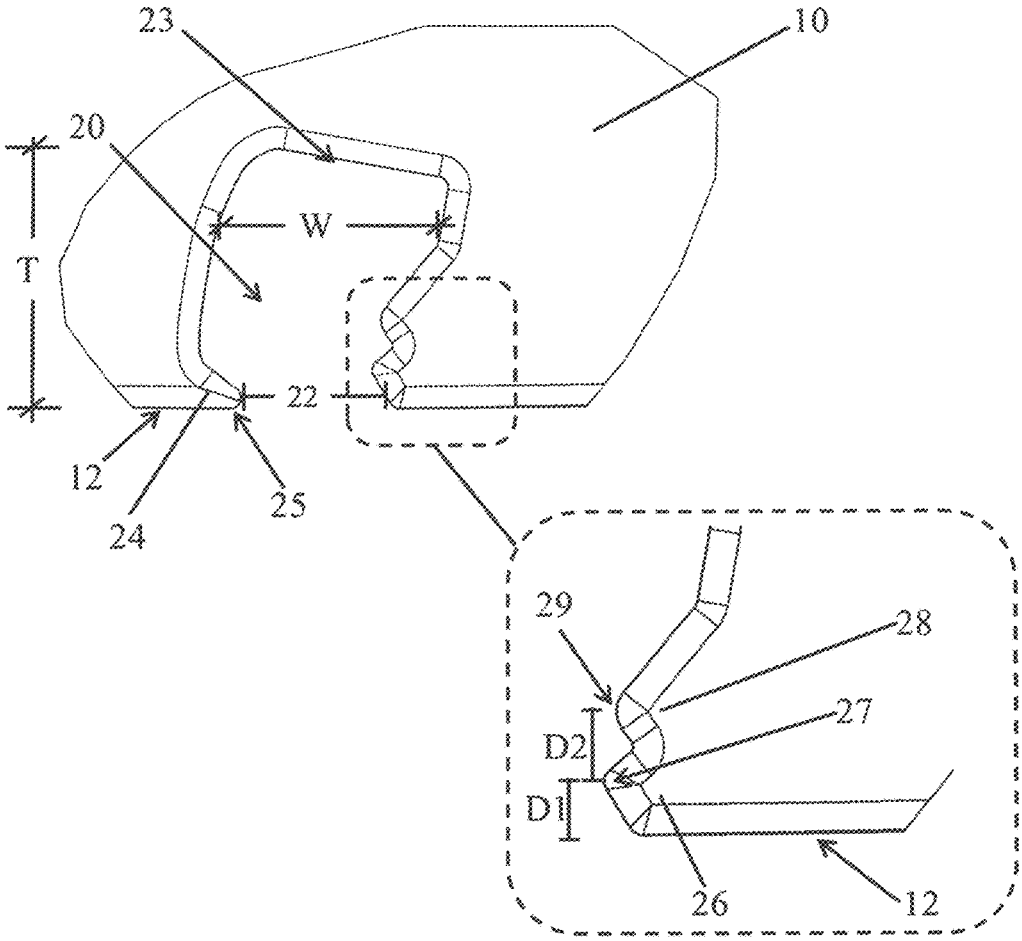
FIG. 4 shows a schematic sketch of another embodiment of the tuft-picking notch 20 having two protrusions 26, 28 located off-site the working surface 12 of the notch 20.

FIG. 4 shows another embodiment of a tuft-picking notch 20. Features which are in common with the tuft-picking notch 20 shown in FIG. 3 are designated with the same reference numerals and are not described in detail again. The tuft-picking notch 20 shown in FIG. 4 has three protrusions 24, 26, 28. The first protrusion 24 is located in the area of the working surface 12 of the notch 20 limiting the opening 22 at one side. The second protrusion 26 and the third protrusion 28 located off-site the working surface 12 of the notch 20. The third protrusion 28 is located adjacent to the second protrusion 26 inside of the tuft-picking notch 20. A distance D1 from the top 27 of the second protrusion 26 to the working surface 12 is in the range of about 0.08 mm to about 0.3 mm. A distance D2 from the top 29 of the third protrusion 28 to the top 27 of the second protrusion 26 is equal to the distance D1 or about 10% more or less the distance D1.

The second projection 26 is formed symmetrically and the angle $\alpha$ between the working surface 12 of the tuft picker 10 and the line of reflection symmetry S crossing the top 27 of the second projection 26 is in the range of about 30°. If the contour of the tuft picker 10 is circular the angle $\alpha$ is measured disclosed in FIG. 3. The third projection 28 is similar formed and shaped than the second projection 26. The third projection 28 is also symmetrically shaped, but projects about 10% less into the notch 20. An angle between the line of reflection symmetry crossing the top 29 of the third projection 29 and the working surface 12 of the tuft-picking notch may be equal or smaller than the angle $\alpha$ between the second projection 26 and the working surface 12. Preferably, the angle between the third projection 28 and the working surface 12 is about 10° smaller than the angle α between the second projection 26 and the working surface 12.

The tuft-picking notch 20 shown in FIG. 4 is an irregular cyclic polygon having rounded edges. The depth T of the tuft-picking notch 20 ranges from a bottom 23 of the notch 20 to the opening 22 of the notch 20 and varies along the width W of the notch 20. In particular, the depth T decreases from the side of the notch 20 comprising the first projection 24 to the side of the notch 20 comprising the second and third projections 26, 28. A suitable maximal depth T is about 5 mm and a suitable minimal depth is about 0.5 mm. Due to the fact that the notch 20 is irregularly shape, the width W is varies along the depth T of the notch 20 continuously. A suitable maximal width W is about 5 mm and a suitable minimal width is about 0.5 mm.

Figure 5:
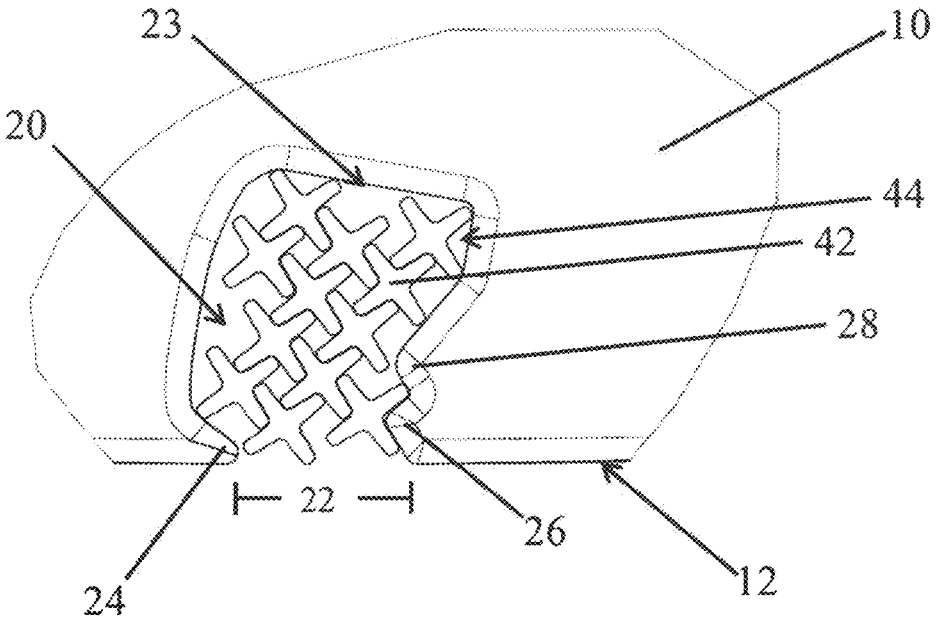
FIG. 5 shows a schematic sketch of the tuft-picking notch 20 shown in FIG. 4 filled with filaments 42.

FIG. 5 shows the tuft-picking notch 20 shown in FIG. 4 after the picking process. Thus, the tuft-picking notch 20 is filled with filaments 42. Features which are in common with the tuft-picking notch 20 shown in in FIG. 4 are designated with the same reference numerals and are not described in detail again. All features described with respect to FIG. 4, whether described individually or in combination, are also applicable to the tuft-picking notch shown in FIG. 5 and are not repeated in detail. The filaments 42 picked with the tuft-picking notch 20 are X-shaped filaments 42. A recess 44 of a filament 42 is arranged perfectly matching at the second protrusion 26. Thus, the filaments 42 are trapped there during the movement of the tuft picker 10 and the protrusion 26 avoids that the filaments 42 are removed from the tuft-picking notch 20 or any filament 42 may be spliced in the area of the working surface 12 of the tuft picker 10. In addition, the irregular shape of the notch 20 prevents any internal movement of the filaments 42.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A tuft-picking device (50) for a brush-making machine, comprising a filament container (40) for holding a supply of loose filaments (42) in a mutually parallel condition wherein a circumference of at least one of the loose filaments (42) comprises at least one recess (44), a tuft picker (10) having a working surface (12) comprising at least one tuft-picking notch (20) having a depth (T), a width (W), and an opening (22), wherein a contour of the working surface (12) is configured to be movable during a working stroke past an open side of the filament container (40) so that the opening (22) of the tuft-picking notch (20) passes the loose filaments (42), wherein a first projection (24) and a second projection (26) reduce the opening (22) of the tuft-picking notch (20) versus an inner width (W), wherein a top (25) of the first projection (24) is located in the working surface (12) of the tuft picker (10) and a top (27) of the second projection (26) is located off-site the working surface (12) of the tuft picker (10) and inside of the tuft-picking notch (20), wherein a distance (D1) from a top (27) of the second projection (26) to the working surface (12) of the tuft picker (10) is from 0.05 mm to 0.5 mm and wherein an angle (a) between the working surface (12) of the tuft picker (10) and a line of reflection symmetry (S) crossing the top (27) of the second projection (26) is from 0° to 45°.

2. The tuft-picking device (50) according to claim 1, wherein the working surface (12) of the tuft picker (10) comprises a circular arc.

3. The tuft-picking device (50) according to claim 1, wherein the angle (a) is from 0° to 40°.

4. The tuft-picking device (50) according to claim 1, wherein the distance (D1) from the top (27) of the second projection (26) to the working surface (12) is from 0.05 mm to 0.4 mm.

5. The tuft-picking device (50) according to claim 1, wherein the top (27) of the second projection (26) projects into the notch (20) from 0.025 mm to 0.25 mm.

6. The tuft-picking device (50) according to claim 1, wherein the tuft-picking notch (20) comprises a third projection (28) located inside the notch (20) and adjacent to the second projection (26).

7. The tuft-picking device (50) according to claim 6, wherein a top (29) of the third projection (28) is spaced from the top (27) of the second projection (26) at a distance (D2) that is equal to the distance (D1) from the top (27) of the second projection (26) to the working surface (12) of the tuft picker (10).

8. The tuft-picking device (50) according to claim 6, wherein a top (29) of the third projection (28) projects less into the notch (20) than the top (27) of the second projection (26).

9. The tuft-picking device (50) according to claim 1, wherein the width (W) of the notch (20) varies along the depth (T) of the notch (20).

10. The tuft-picking device (50) according to claim 1, wherein the width (W) of the tuft-picking notch (20) is smaller than the depth (T) of the tuft-picking notch (20).

11. The tuft-picking device (50) according to claim 1, wherein the depth (T) of the notch (20) varies along the opening (22).

12. The tuft-picking device (50) according to claim 1, wherein the tuft-picking notch (20) has a shape selected from the group consisting of a circle, an oval, a polygon, and any combination thereof.

13. The tuft-picking device (50) according to claim 2, wherein the working surface (12) of the tuft picker (10) comprises a circular arc having a curvature/diameter from 80 mm to 300 mm.

14. The tuft-picking device (50) according to claim 3, wherein the angle is from 5° to 20°.

15. The tuft-picking device (50) according to claim 4, wherein the distance (D1) from the top (27) of the second projection (26) to the working surface (12) is from 0.05 mm to 0.35 mm.

16. The tuft-picking device (50) according to claim 5, wherein the top (27) of the second projection (26) projects into the notch (20) from 0.025 mm to 0.2 mm.

17. The tuft-picking device (50) according to claim 7, wherein a top (29) of the third projection (28) is spaced from the top (27) of the second projection (26) at a distance (D2) that is ±10% of the distance (D1) from the top (27) of the second projection (26) to the working surface (12) of the tuft picker (10).

* * * * *